US011266290B2

(12) United States Patent
Becker et al.

(10) Patent No.: US 11,266,290 B2
(45) Date of Patent: Mar. 8, 2022

(54) DOMESTIC DISHWASHER HAVING INCREASED RIGIDITY IN A REGION OF CONNECTION FLANGES OF BASE AND REAR WALL

(71) Applicant: BSH Hausgeräte GmbH, Munich (DE)

(72) Inventors: Martin Becker, Haunsheim (DE); Johann Schabert, Holzheim (DE); Norbert Näßler, Aulendorf (DE)

(73) Assignee: BSH Hausgeräte GmbH, Munich (DE)

( * ) Notice: Subject to any disclaimer, the term of this patent is extended or adjusted under 35 U.S.C. 154(b) by 247 days.

(21) Appl. No.: 16/609,487

(22) PCT Filed: May 9, 2018

(86) PCT No.: PCT/EP2018/062044

§ 371 (c)(1),
(2) Date: Oct. 30, 2019

(87) PCT Pub. No.: WO2018/219616

PCT Pub. Date: Dec. 6, 2018

(65) Prior Publication Data

US 2020/0138262 A1 May 7, 2020

(30) Foreign Application Priority Data

May 31, 2017 (DE) ..... 10 2017 209 244.0

(51) Int. Cl.
*A47L 15/42* (2006.01)

(52) U.S. Cl.
CPC ..... *A47L 15/427* (2013.01); *A47L 15/4246* (2013.01); *A47L 15/4253* (2013.01)

(58) Field of Classification Search
CPC ..... A47L 15/427; A47L 15/42546; A47L 15/4253; A47L 15/4246
See application file for complete search history.

(56) References Cited

U.S. PATENT DOCUMENTS 5,882,096 A * 3/1999 Wilhelmstatter ... A47L 15/4272 312/228
2009/0126765 A1* 5/2009 Buehlmeyer ..... A47L 15/4268 134/115 R (Continued)

FOREIGN PATENT DOCUMENTS

DE 19611049 A1 9/1997
DE 19611055 A1 9/1997

(Continued)

OTHER PUBLICATIONS

Machine English Translation of Description of DE 10 2010 038 477 A1 (Hermann) (Year: 2012).*

(Continued)

*Primary Examiner* — Joseph L. Perrin
*Assistant Examiner* — Irina Graf
(74) *Attorney, Agent, or Firm* — Michael E. Tschupp; Andre Pallapies; Brandon G. Braun

(57) ABSTRACT

A household dishwasher includes a dishwasher cavity which includes a base having a first connection flange, a dishwasher cavity casing connected to the base, and a rear wall connected to both the base and the dishwasher cavity casing. The rear wall includes a second connection flange having at least one section resting against the first connection flange. The second connection flange has a deformation region which projects beyond the first connection flange and is bent in a direction oriented away from the first connection flange in such a way that the deformation region rests against the second connection flange.

15 Claims, 5 Drawing Sheets

(56) References Cited

U.S. PATENT DOCUMENTS

| | | | |
|---|---|---|---|
| 2010/0132749 | A1 | 6/2010 | Buehlmeyer et al. |
| 2013/0068266 | A1 | 3/2013 | Bennett et al. |

FOREIGN PATENT DOCUMENTS

| | | | | | |
|---|---|---|---|---|---|
| DE | 102007017280 | A1 | | 10/2008 | |
| DE | 102010038477 | A1 | | 2/2012 | |
| DE | 102011088129 | A1 | * | 6/2013 | ..... A47L 15/4246 |
| EP | 1138248 | A2 | | 10/2001 | |
| EP | 2430965 | A2 | | 3/2012 | |
| EP | 1971251 | B1 | | 1/2015 | |
| GB | 2064309 | A | | 6/1981 | |

OTHER PUBLICATIONS

International Search Report PCT/Ep2018/062044 dated Aug. 17, 2018.

* cited by examiner

DOMESTIC DISHWASHER HAVING INCREASED RIGIDITY IN A REGION OF CONNECTION FLANGES OF BASE AND REAR WALL

CROSS-REFERENCES TO RELATED APPLICATIONS

This application is the U.S. National Stage of International Application No. PCT/EP2018/062044, filed May 9, 2018, which designated the United States and has been published as International Publication No. WO 2018/219616 A1 and which claims the priority of German Patent Application, Serial No. 10 2017 209 244.0, filed May 31, 2017, pursuant to 35 U.S.C. 119(a)-(d).

BACKGROUND OF THE INVENTION

The present invention relates to a household dishwasher.

In most cases a dishwasher has a dishwasher cavity and a base support which supports the dishwasher cavity. The dishwasher cavity is typically formed from a number of sections of sheet metal. For instance, the dishwasher cavity comprises a base and a rear wall which are connected to one another with the aid of connection flanges, for instance.

The publication DE 196 11 049 A1 discloses a dishwasher having a box-shaped dishwasher cavity made from at least two sheet metal parts, of which the one sheet metal part forms the two side walls, the upper wall and the base of the container and the other sheet metal part forms the rear wall of the container and which have flanges arranged externally on the container along its opposing edge zones, at which flanges they are connected to one another by means of welding, wherein in the disassembled state, the flanges of the rear wall project beyond the flanges of the further parts of the container and in the assembly the projecting parts of the flanges of the rear wall are bent so as to overlap in the direction of the further parts of the container and the flanges of the further parts of the container.

The publication DE 196 11 055 A1 discloses a dishwasher with a machine base on which a dishwasher cavity can be placed, wherein on the rear side the dishwasher cavity rests on the top edge of the machine base.

BRIEF SUMMARY OF THE INVENTION

Against this background, an object of the present invention is to provide an improved household dishwasher.

Accordingly, a household dishwasher with a dishwasher cavity, which comprises a base, a dishwasher cavity casing connected to the base and a rear wall connected both with the base and also with the dishwasher cavity casing, is proposed, wherein the base comprises a first connection flange and the rear wall comprises a second connection flange that rests against the first connection flange at least in sections, wherein the second connection flange has a deformation region, which projects beyond the first connection flange, and wherein the deformation region is bent in a direction oriented away from the first connection flange in such a way that the deformation region rests against the second connection flange.

As a result of the deformation region being bent in the direction oriented away from the first connection flange and not in an opposite direction, in other words toward the first connection flange, the installation space required for the connection flange can be reduced. This makes it possible, for instance, to dispense with a change in position of components received in a base support of the household dishwasher.

The fact that the deformation region is bent in the direction oriented away from the first connection flange is understood to mean that the deformation region is not deformed in the direction of the first connection flange, but instead away therefrom. In this way the deformation region does not rest against the first connection flange, but instead against the second connection flange. In other words, if the deformation region is deformed, the second connection flange is arranged between the deformation region and the first connection flange. A triple sheet thickness is produced here in the region of the connection flange. This increases the rigidity in the region of the connection flanges. The fact that the second connection flange projects beyond the first connection flange with its deformation region is in particular to be understood to mean that in a direction toward a base of a receiving region of the base support of the household dishwasher, the deformation region projects beyond the first connection flange.

The deformation region is in particular part of the second connection flange. The deformation region can be brought from a non-deformed state, in which the second connection flange and the deformation region form a shared plane, into a deformed state, by the deformation region resting against the second connection flange. A sealing device for sealing the first connection flange with respect to the second connection flange can be provided between the first connection flange and the second connection flange. The sealing device can be manufactured from a thermoplastic elastomer, for instance. A groove can be provided on the rear wall for receiving the sealing device.

According to one embodiment, the dishwasher cavity casing is embodied in one piece and comprises a first side wall, a second side wall and a ceiling arranged between the first side wall and the second side wall.

Here one-piece is understood to mean that the first side wall, the second side wall and the ceiling form a single-piece component. For instance, the dishwasher cavity casing is a one-piece section of sheet metal which comprises the first side wall, the second side wall and the ceiling. The dishwasher cavity casing can have a U-shaped geometry and is positioned on the base. The base is fixedly connected to the side walls of the dishwasher casing, for instance welted and/or welded. The rear wall is fixedly connected to the dishwasher cavity casing and the base, for instance welted and/or welded.

According to a further embodiment, the first connection flange is point-welded to the second connection flange.

This allows a secure connection to be achieved between the first connection flange and the second connection flange. To seal the first connection flange in a water-tight manner relative to the second connection flange, the previously mentioned sealing device is used.

According to a further embodiment, the deformation region has cut-outs, in particular drop-shaped cut-outs.

The cut-outs are provided on a lower region of the rear wall and are arranged uniformly at a distance from one another in a transverse direction of the rear wall. Finger-shaped sections are provided between the cut-outs and rest against the second connection flange.

According to a further embodiment, the deformation region in the region of the cut-outs rests against the second connection flange.

In other words, preferably only the previously mentioned finger-shaped sections, which are arranged between the cut-outs, rest against the second connection flange. The drop-shaped cut-outs and the open geometry resulting therefrom can achieve increased rigidity in the region of the connection flange.

According to a further embodiment, fastening points, in particular welding points, for connecting the first connection flange with the second connection flange, are provided in the cut-outs.

A fastening point of this type is in particular assigned to each cut-out. Alternatively, a number of fastening points can also be assigned to each cut-out.

According to a further embodiment, the household dishwasher comprises a base support, which supports the dishwasher cavity, wherein the deformation region rests on the base support.

The base support is preferably a plastic component. In particular, the base support is a plastic injection molded component. In particular, the deformation region with a supporting surface rests on the base support.

According to a further embodiment, the deformation region rests on the base support at two supporting points arranged at a distance from one another.

The supporting points are preferably provided laterally on the base support. In the region of the supporting points, the deformation region and the connection flange can deform elastically and/or plastically, so that damage to the base support, in the case of a significant load due to impacts for instance, is prevented.

According to a further embodiment, the household dishwasher has a fastening means, in particular a screw, which is passed through a passage provided in the first connection flange and/or the second connection flange, and is fixedly connected to the base support, wherein the dishwasher does not rest on the fastening means.

A plurality, for instance two, such fastening means is preferably provided. In particular, the fastening means is screwed into the base support. The passage is in particular embodied as an elongated hole. The passage is dimensioned so that the fastening means never makes contact with a wall of the passage. This reliably prevents the dishwasher cavity from resting on the fastening means. This always ensures that the dishwasher cavity only rests on the base support. With the aid of the fastening means and the passage, it is possible to achieve a floating support of the dishwasher cavity on the rear wall. A direct introduction of force from the dishwasher cavity into the fastening means and from this into the base support is prevented. In this way it is possible to reliably avoid breaking the base support and/or a crack forming in the base support.

According to a further embodiment, the base support has a receiving area in which the first connection flange and the second connection flange are received, wherein the deformation region rests on a base of the receiving region.

The receiving section is in particular embodied in the form of a groove. The deformation region rests on the base with its supporting surface.

Further possible implementations of the household dishwasher also include combinations of features or embodiments described above or below with regard to exemplary embodiments, even if these combinations are not mentioned explicitly. The person skilled in the art will also add individual aspects as improvements or additions to the relevant basic form of the household dishwasher.

Further advantageous embodiments and aspects of the household dishwasher form the subject matter of the dependent claims and of the exemplary embodiments of the household dishwasher that are described below. The household dishwasher is described in greater detail below using preferred embodiments with reference to the accompanying figures.

BRIEF DESCRIPTION OF THE DRAWINGS

In which.

DETAILED DESCRIPTION OF EXEMPLARY EMBODIMENTS OF THE PRESENT INVENTION

Figure 1:
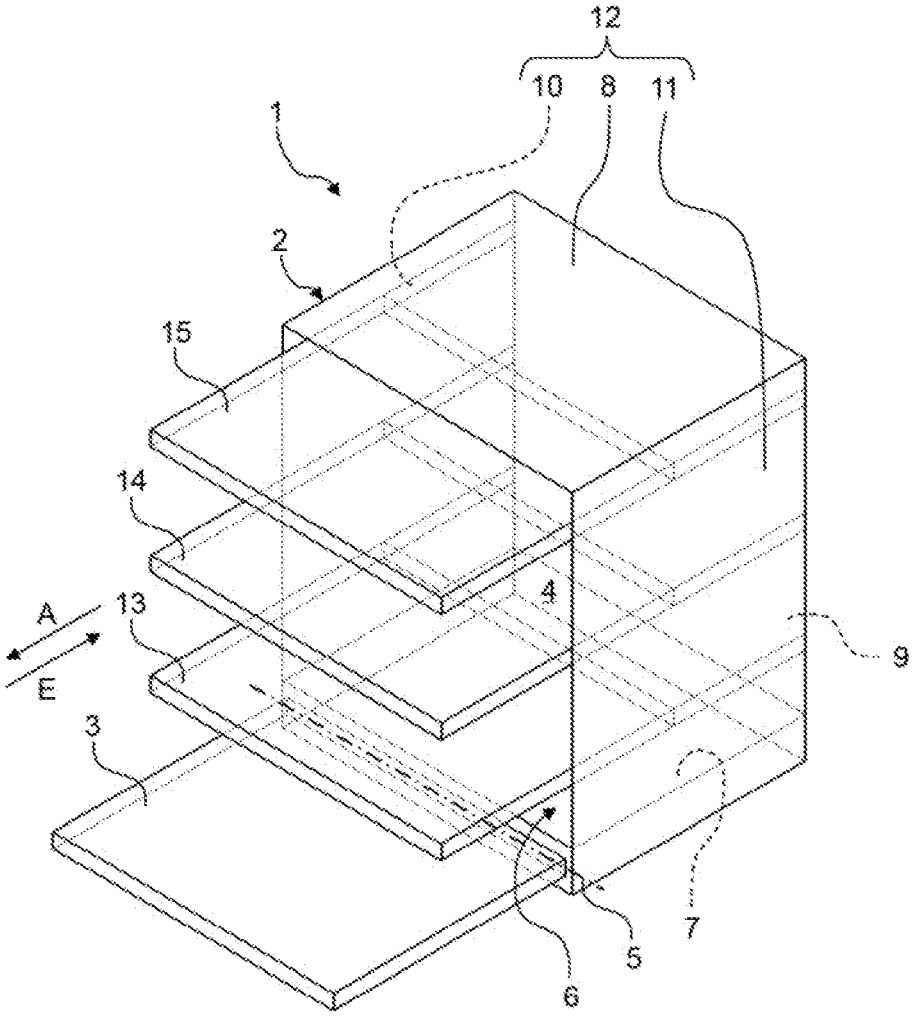
FIG. 1 shows a schematic perspective view of an embodiment of a household dishwasher.

In the figures, elements that are identical or have the same function are denoted by the same reference characters unless otherwise stated.

FIG. 1 shows a schematic perspective view of an embodiment of a household dishwasher 1. The household dishwasher 1 comprises a dishwasher cavity 2, which can be closed by a door 3, in particular in a watertight manner. To this end, a sealing facility can be provided for this purpose between the door 3 and the dishwasher cavity 2. The dishwasher cavity 2 is preferably cuboid in shape. The dishwasher cavity 2 may be arranged in a housing of the household dishwasher 1. The dishwasher cavity 2 and the door 3 may form a washing chamber 4 for washing items to be washed.

The door 3 is shown in its open position in FIG. 1. The door 3 can be closed or opened by pivoting about a pivot axis 5 provided at a lower end of the door 3. With the aid of the door 3, a loading opening 6 of the dishwasher cavity 2 can be closed or opened. The dishwasher cavity 2 has a base 7, a ceiling 8 arranged opposite to the base 7, a rear wall 9 arranged facing the closed door 3 and two side walls 10, 11 arranged facing one another. The base 7, the ceiling 8, the rear wall 9 and the side walls 10, 11 may be manufactured from a stainless-steel sheet for example. A first side wall 10, a second side wall 11 and the ceiling 8 arranged between the first side wall 10 and the second side wall 1 are in one piece, in particular as a single piece, and form a dishwasher cavity casing 12 of the dishwasher 2. The dishwasher cavity casing 12, the rear wall 9 and the base 7 are components which are manufactured separately from one another, and which are connected to one another in a water-tight manner, however.

The household dishwasher 1 further has at least one receptacle for items to be washed 13 to 15. Preferably, a plurality of receptacles for items to be washed 13 to 15, for instance three, can be provided, wherein the receptacle for items to be washed 13 may be a lower rack or lower basket, the receptacle for items to be washed 14 may be an upper rack or upper basket and the receptacle for items to be washed 15 may be a cutlery drawer. As FIG. 1 also shows, the receptacles for items to be washed 13 to 15 are arranged one above the other in the dishwasher cavity 2. Each receptacle for items to be washed 13 to 15 is optionally able to be shifted into or out from the dishwasher cavity 2. Each receptacle for items to be washed 13 to 15 is able to be inserted into the dishwasher cavity 2 in an insertion direction E (arrow) and extracted from the dishwasher cavity 2 in an extraction direction A (arrow) opposite to the insertion direction E (arrow).

Figure 2:
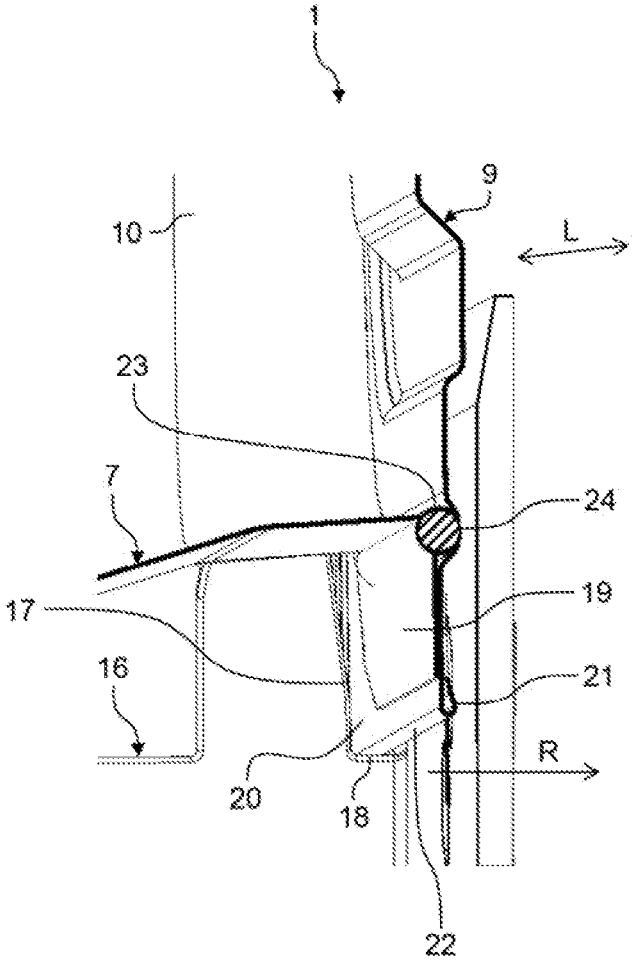
FIG. 2 shows a schematic perspective partial sectional view of the household dishwasher according to FIG. 1.

FIG. 2 shows a schematic perspective partial sectional view of the household dishwasher 1. The household dishwasher 1 comprises, aside from the dishwasher cavity 2, a base support 16 which supports the dishwasher cavity 2. The base support 16 is preferably manufactured from a plastic material. In particular, the base support 16 is a plastic injection molded part. The base support 16 comprises a groove-shaped receiving area 17 with a base 18.

As FIG. 2 also shows, the base 7 comprises a folded first connection flange 19 which is bent about 90° relative to the base 7. The rear wall 9 comprises a second connection flange 20 which corresponds to the first connection flange 19. The second connection flange 20 rests against the first connection flange 19 at least in sections. The second connection flange 20 comprises a deformation region 21, which is bent so that the deformation region 21 rests against the second connection flange 20 itself. In particular, the deformation region 21 does not rest against the first connection flange 19.

As FIG. 2 shows, the second connection flange 20 projects in the direction of the base 18 of the receiving region 17 of the base support 16 to beyond the first connection flange 19. In other words, the second connection flange 20, and in particular the deformation region 21, is longer in the direction of the base 18 than the first connection flange 19. The deformation region 21 is bent in a direction R orientated away from the first connection flange 19 so that the deformation region 21 rests against the second connection flange 20. In other words, the deformation region 21 is not bent in the direction of the first connection flange 19, but instead away therefrom.

The fact that the deformation region 21 is resting on the second connection flange 20 results in a triple sheet thickness there where the deformation region 21, the second connection flange 20 and the first connection flange 19 are arranged on top of one another. This achieves particularly high rigidity. The second connection flange 20 is therefore positioned between the first connection flange 19 and the deformation region 21. The deformation region 21 rests on the base 18 of the receiving region 17 in particular with a supporting surface 22.

The first connection flange 19 is preferably welded to the second connection flange 20, in particular point-welded. A sealing device 23 is provided to seal the first connection flange 19 with respect to the second connection flange 20 and also to seal the rear wall 9 with respect to the dishwasher cavity casing 12 in a water-tight manner. A groove 24 can be provided on the rear wall 9 for receiving the sealing device 23. The sealing device 23 is preferably a sealing cord. The sealing device 23 can be manufactured from a thermoplastic elastomer, in particular from a thermoplastic polyurethane, for instance. A longitudinal direction of the dishwasher cavity 2 referred to with reference character L in FIG. 2 is oriented at right angles to the rear wall 9.

Compared with an arrangement in which the deformation region 21 is not bent in direction R away from the first connection flange 19, but instead toward thereto, a reduced overall height of the connection flange 19, 20 can be achieved. This achieves a space saving. This can create space for components located in the base support 16, for instance. As a result of the reduced overall height, the notch effect on the base 18 of the receiving region 17 of the base support 16 can be reduced. This prevents the base support 16 from breaking and/or forming cracks.

Figure 3:
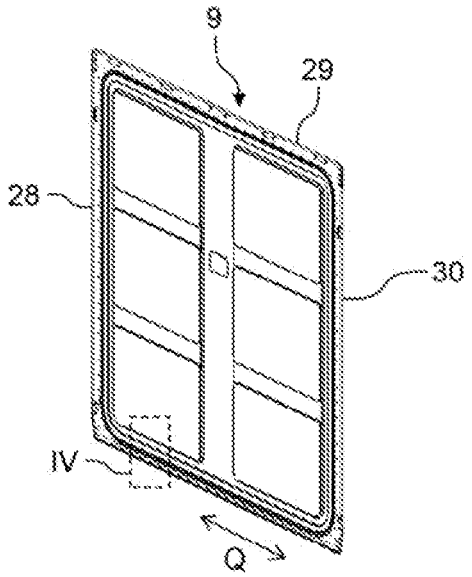
FIG. 3 shows a schematic perspective view of an embodiment of a rear wall for a dishwasher cavity of the household dishwasher according to FIG. 1.
Figure 4:
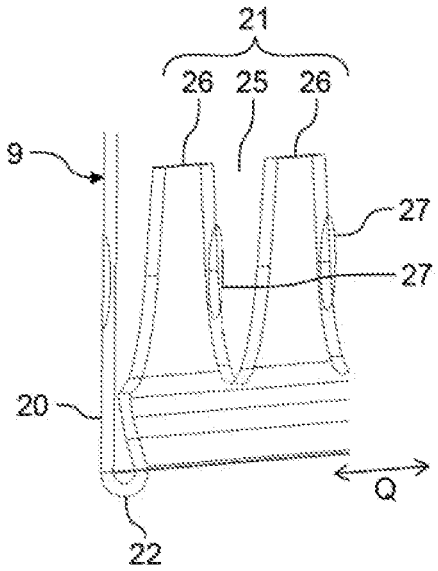
FIG. 4 shows the detailed view IV according to FIG. 3.

FIG. 3 shows a schematic perspective view of an embodiment of the rear wall 9. FIG. 4 shows the detailed view IV according to FIG. 3. As shown in FIG. 4, the deformation region 21 comprises a plurality of cut-outs 25, of which only one is provided with a reference character in FIG. 4, however. The cut-outs 25 are arranged at a uniform distance from one another in a transverse direction Q of the rear wall 9 or the dishwasher cavity 2. The cut-outs 25 are in particular drop-shaped. Finger-shaped sections 26 of the deformation region 21 are provided between the cut-outs 25 such that the sections 26 and the cut-outs 25 are arranged alternately.

The deformation region 21 rests on the second connection flange 20 in particular just with the finger-shaped sections 26. Compared with a closed geometry without cut-outs 25 of this type, the open drop-shaped geometry of the cut-outs 25 allows higher forces to be absorbed on account of its reinforcing effect. Fastening points 27, in particular welded points, are provided in the cutouts 25, in order to connect the first connection flange 19 with the second connection flange 20. As shown in FIG. 4, the rear wall 9 comprises still further connection flanges 28 to 30 in addition to the second connection flange 20. These connection flanges 28 to 30 are however not canted up in the direction R, but instead opposite hereto. The rear wall 9 is connected to the dishwasher cavity casing 12 with the aid of the connection flange 29 to 30.

Figure 5:
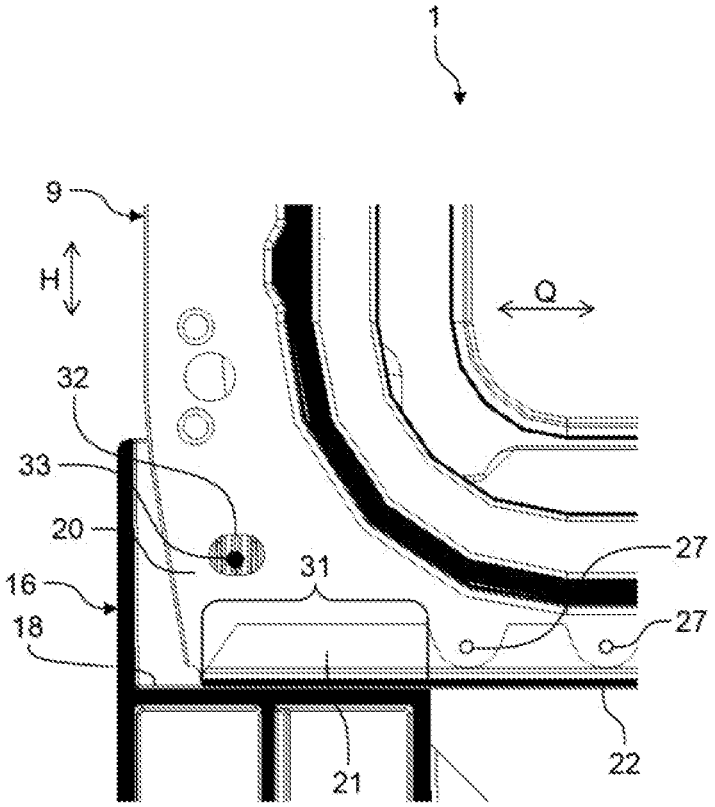
FIG. 5 shows a schematic partial sectional view of the household dishwasher according to FIG. 1.

FIG. 5 shows a schematic partial sectional view of the household dishwasher 1 in a viewing direction from the rear of the same. As FIG. 5 shows, the deformation region 21 rests with its supporting surface 22 on a corresponding resting point 31 of the base 18 of the receiving region 17. Two such resting points 31 are preferably provided, which are arranged at a distance from one another. The supporting surface 22 is not supported between the resting points 31. The deformation region 21 and/or the connection flange 19, 20 can deform plastically and/or elastically in the region of the resting points 31. This prevents damage to the base support 16, for instance in the event of an incorrect supply of the household dishwasher 1 and a significant load due to impacts which results therefrom.

As also shown in FIG. 5, a passage 32 is provided on the rear wall. The passage 32 passes through the first connection flange 19 and/or the second connection flange 20. The passage 32 is embodied in particular as an elongated hole which extends in the transverse direction Q. A fastening means 33, which does not make contact with a wall of the passage 32, however, passes through the passage 32. To this end, the dimensions of the passage 32 in the transverse direction Q and in a height direction H are selected such that the fastening means 33, which is preferably embodied as a screw, neither makes contact with the wall of the passage 32 during transportation nor during operation of the household dishwasher 1. In other words, the dishwasher cavity 2 does not rest against the fastening means 33 but instead against the base support 16. A floating bearing is achieved as a result.

Figure 6:
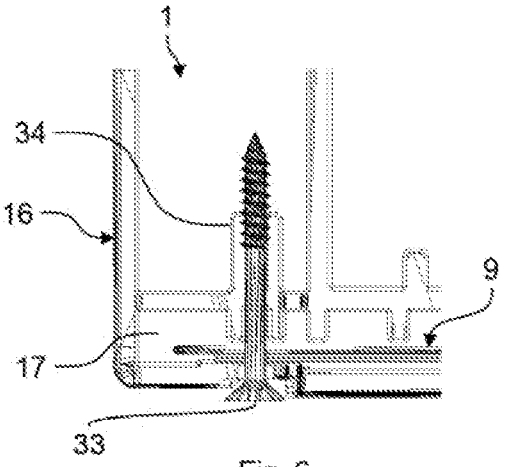
FIG. 6 shows a further schematic partial sectional view of the household dishwasher according to FIG. 1.
Figure 7:
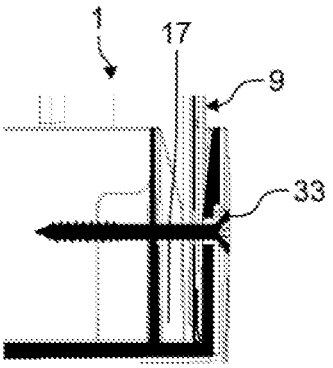
FIG. 7 shows a further schematic partial sectional view of the household dishwasher according to FIG. 1.
Figure 8:
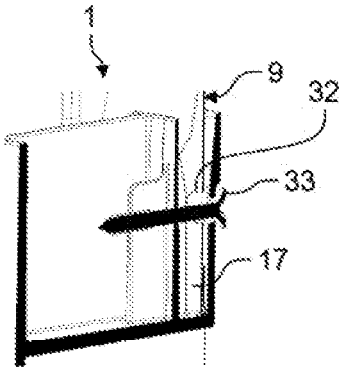
FIG. 8 shows a further schematic partial sectional view of the household dishwasher according to FIG. 1.

FIGS. 6 to 8 show different detailed views of the fastening means 33 passed through the passage 32. The fastening means 33 is screwed into the base support 16. To this end a receiving section 34, in particular an internal thread, can be provided on the base support 16. The fastening means 33 is screwed into the receiving section 34. The fastening means 33 is passed through the receiving region 17 of the base support 16. The dishwasher cavity 2, and in particular the rear wall 9, does not make contact with the fastening means 33, as previously mentioned. This ensures that the deformation region 21 only ever rests on the base support 16.

The household dishwasher 1 has the following advantages. The position of a water stop apparatus can remain unchanged in the base support 16. The weight of the household dishwasher 1 does not increase as a result of the shortened geometry which results from the deformation region 21 being bent away from the first connection flange 19 in the direction R. The force transmission can be optimized with the aid of the drop-shaped cut-outs 25, and a folding-over of the rear wall 9 in the region of the connection flanges 19, 20 is prevented. An additional reinforcement is produced as a result of the three-layered arrangement of the two connection flanges 19, 20 and the deformation region 21. A further increase in the rigidity is achieved by the shortened height of the connection flanges 19, 20.

The rounded geometry of the second connection flange 20 assists with a joining movement during the swiveling-in of the dishwasher cavity 2 into the base support 16. The floating bearing of the dishwasher cavity 2 in the transverse direction Q and in the height direction H in the region of the passage 32 is necessary for the tolerance compensation and thus an integral part of a fixed bearing in the region of a frame and/or hinge connection of the household dishwasher 1. Forces acting in the longitudinal direction L firstly deform the rear wall 9, as a result of which the forces are absorbed, before the complete forces act on the base support 16. This prevents a formation of cracks in the base support 16.

Although the present invention has been described with reference to exemplary embodiments, it can be modified in numerous different ways.

The invention claimed is:

1. A household dishwasher, comprising a dishwasher cavity, said dishwasher cavity comprising:

a base including a first connection flange which is bent about 90° downward relative to the base, a dishwasher cavity casing connected to the base, and a rear wall connected to both the base and the dishwasher cavity casing and including a second connection flange having at least one section resting against the first connection flange, said second connection flange having a deformation region that projects beyond the first connection flange and is bent around in a direction oriented away from the first connection flange in such a way that an outermost edge of the deformation region rests against the second connection flange.

2. The household dishwasher of claim 1, wherein the dishwasher cavity casing is embodied in one piece and comprises a first side wall, a second side wall, and a ceiling arranged between the first side wall and the second side wall.

3. The household dishwasher of claim 1, wherein the first connection flange is point-welded to the second connection flange.

4. The household dishwasher of claim 1, wherein the deformation region has cut-outs.

5. The household dishwasher of claim 4, wherein the cut-outs are drop-shaped.

6. The household dishwasher of claim 4, wherein the deformation region rests against the second connection flange in a region of the cut-outs.

7. The household dishwasher of claim 4, wherein the first connection flange is connected to the second connection flange via fastening points in the cut-outs.

8. The household dishwasher of claim 7, wherein the fastening points are welded points.

9. The household dishwasher of claim 1, further comprising a base support configured to support the dishwasher cavity, said deformation region resting on the base support.

10. The household dishwasher of claim 9, wherein the deformation region rests on the base support at two resting points arranged at a distance from one another.

11. The household dishwasher of claim 9, further comprising a fastener configured to pass through a passage in at least one of the first connection flange and the second connection flange, said fastener being fixedly connected to the base support wherein the dishwasher cavity does not rest on the fastener.

12. The household dishwasher of claim 11, wherein the fastener is a screw.

13. The household dishwasher of claim 9, wherein the base support has a receiving region configured to receive the first connection flange and the second connection flange, said deformation region resting on a base of the receiving region.

14. The household dishwasher of claim 1, wherein the second connection flange is positioned between the first connection flange and the deformation region.

15. A household dishwasher with a dishwasher cavity and a base support, which comprises a groove-shaped receiving region with a base portion and which supports the dishwasher cavity, wherein the dishwasher cavity comprises a base, a dishwasher cavity casing connected to the base and a rear wall connected both to the base and also to the dishwasher cavity casing, wherein the base comprises a first connection flange and the rear wall comprises a second connection flange that rests against the first connection flange of the base at least in sections and wherein the second connection flange of the rear wall has a deformation region, wherein the deformation region of the second connection flange of the rear wall projects in a downward direction onto the base portion of the groove-shaped receiving region of the base support to beyond the first connection flange of the base, and the deformation region of the second connection flange of the rear wall is bent in a direction (R) oriented away from the first connection flange of the base in such a way that an outermost edge of the deformation region of the second connection flange of the rear wall rests against the second connection flange of the rear wall.

* * * * *